US010441048B2

(12) United States Patent
Grez

(10) Patent No.: US 10,441,048 B2
(45) **Date of Patent: *Oct. 15, 2019**

(54) HAIR COLORING APPLIANCE

(71) Applicant: L'ORÉAL, Paris (FR)

(72) Inventor: Joseph Grez, North Bend, WA (US)

(73) Assignee: L'ORÉAL, Paris (FR)

( * ) Notice: Subject to any disclaimer, the term of this patent is extended or adjusted under 35 U.S.C. 154(b) by 0 days.

This patent is subject to a terminal disclaimer.

(21) Appl. No.: 15/937,703

(22) Filed: Mar. 27, 2018

(65) Prior Publication Data

US 2018/0213912 A1 Aug. 2, 2018

Related U.S. Application Data

(63) Continuation of application No. 14/554,789, filed on Nov. 26, 2014, now Pat. No. 9,949,545.

(51) Int. Cl.

| | |
|---|---|
| ***A45D 19/02*** | (2006.01) |
| ***A45D 19/00*** | (2006.01) |
| ***A45D 24/22*** | (2006.01) |
| ***A46B 11/06*** | (2006.01) |
| ***A46B 13/04*** | (2006.01) |
| ***A46B 11/00*** | (2006.01) |
| *B01F 5/06* | (2006.01) |

(Continued)

(52) U.S. Cl.

CPC ..... *A45D 19/02* (2013.01); *A45D 19/00* (2013.01); *A45D 19/0008* (2013.01); *A45D 24/22* (2013.01); *A46B 11/0055* (2013.01); *A46B 11/063* (2013.01); *A46B 13/04* (2013.01); *A45D 2019/0066* (2013.01); *A45D 2019/0091* (2013.01); *A45D 2200/058* (2013.01); *B01F 5/0615* (2013.01); *B01F 13/1069* (2013.01); *B01F 15/0243* (2013.01); *B01F 2013/1052* (2013.01)

(58) Field of Classification Search

CPC .... A45D 2019/0066; A45D 2019/0083; A45D 2019/0091; A45D 19/00; A45D 19/02; A45D 24/22; A46B 11/06; A46B 11/063; A46B 13/04

USPC ..... 132/112, 113, 114, 116, 148; 401/188 R; 222/63, 135, 145.6

See application file for complete search history.

(56) References Cited

U.S. PATENT DOCUMENTS 3,850,180 A * 11/1974 Ryckman, Jr. ..... A45D 24/007 132/112

6,012,462 A * 1/2000 Schmittou ..... A45D 19/02 132/112

(Continued)

FOREIGN PATENT DOCUMENTS

WO WO-0241801 A1 * 5/2002 ..... A61K 8/02

*Primary Examiner* — Tatiana L Nobrega

(74) *Attorney, Agent, or Firm* — Jensen & Puntigam, P.S.; Clark A. Puntigam

(57) ABSTRACT

The system includes a hair color packet assembly having one hair color packet and one developer packet and a pump assembly for moving the hair coloring material and developer material to a mixing assembly which mixes the color and the developer and delivers it to a brushhead/distributor, which has openings through which the selected hair color formulation is delivered. The brushhead/distributor is mountable in a handle having a motor which drives the brushhead/distributor in a linear oscillating manner.

14 Claims, 4 Drawing Sheets

(51) Int. Cl.
*B01F 13/10* (2006.01)
*B01F 15/02* (2006.01)

(56) References Cited

U.S. PATENT DOCUMENTS

| | | | | |
|---|---|---|---|---|
| 6,505,986 | B1 * | 1/2003 | Oder | A45D 19/02 222/211 |
| 6,877,924 | B1 * | 4/2005 | Mears | A45D 19/02 132/113 |
| 7,225,758 | B1 * | 6/2007 | Galloway | A01K 13/001 119/603 |
| 8,220,469 | B1 * | 7/2012 | Spagnuolo | A45D 19/02 132/114 |
| 2002/0139383 | A1 * | 10/2002 | Christensen | A45D 19/02 132/114 |
| 2005/0184091 | A1 * | 8/2005 | Abergel | A45D 19/02 222/145.5 |
| 2006/0021627 | A1 * | 2/2006 | Lee | A45D 19/02 132/113 |
| 2008/0308117 | A1 * | 12/2008 | Wright | A45D 19/02 132/112 |
| 2009/0320868 | A1 * | 12/2009 | Wang | A45D 19/02 132/116 |
| 2016/0058156 | A1 * | 3/2016 | Chiasson | A45D 40/24 132/200 |

* cited by examiner

HAIR COLORING APPLIANCE

TECHNICAL FIELD

This invention relates generally to hair coloring appliances and methods, and more particularly concerns a hair coloring appliance which permits the user to select and control the particular hair color formulation to be provided by the appliance.

BACKGROUND OF THE INVENTION

Coloring of hair, particularly by a user at home, while it can produce satisfactory results, can be cumbersome and can sometimes lead to unpredictable or unsatisfactory results. It is also time-consuming and requires significant cleanup. The process usually involves a sequence of specific steps, including the user opening one or more containers and mixing the contents to produce the advertised color formulation. The formulation is then applied by the user to the hair, including rubbing it in to the hair area and then combing it in. The hairline is done first, then the hair roots, and then the remaining bulk of the hair. The tools must then be cleaned and put away. The overall process and particularly the unpredictability of the results leads to a general lack of confidence on the part of most users, particularly home users. Accordingly, a hair coloring system useful at home which provides reliable, predictable results and has the capability of a wide variety of coloring is desirable.

SUMMARY OF THE INVENTION

Accordingly, in one arrangement, the hair coloring system comprises: a hair color packet assembly including one coloring material chamber containing coloring dye and one developer material chamber containing developer material; a pump assembly operatively coupled to the coloring material chamber and the developer material chamber for dispensing the coloring dye material and the developer material; output lines from the pump assembly receiving the dye material and the developer material, the output lines merging into a mixer line containing a mixer element which receives and mixes the coloring dye material and the developer material dispensed by the pump assembly to produce a hair formulation; a brushhead connected to the mixer line via a connecting line, wherein the brushhead includes a plurality of tines, one or more of which include openings through which the coloring material moves, the brushhead further including bristles which extend past the lower ends of the tines, contacting the scalp, wherein the tines are positioned above the scalp to allow the hair formulation to escape therefrom; and a handle extending from the brushhead.

Another arrangement is a single use hair color consumable assembly for use with a hair coloring system, comprising: a hair color packet assembly having one hair coloring material chamber and one developer material chamber, wherein the hair coloring material chamber includes hair coloring material and the developer chamber includes developer material; a pump assembly operatively connected to the coloring material chamber and the developer chamber for dispensing the coloring material and the developer material; output lines from the pump assembly for receiving the coloring material and the developer material dispensed by the pump assembly; the output lines merging into a mixer line containing a mixer element which receives and mixes the coloring material and the developer material dispensed by the pump assembly, producing a hair formulation; and a brushhead member connected to the mixing assembly by a connecting line, the brushhead assembly including a plurality of tines, one or more of which include openings through which the coloring material moves, the brushhead further including bristles which extend past the lower end of the tines, contacting the scalp, wherein the tines are positioned slightly above the scalp allowing the hair formulation to escape therefrom.

In another arrangement, a hair coloring system comprises; a hair color packet assembly having one hair coloring materiel chamber containing coloring dye material and one materiel chamber containing developer material; a pump assembly operatively connected to the hair coloring material chamber and the developer material chamber for dispensing the coloring dye material and the developer material; wherein the pump assembly includes output lines for the coloring dye material and the developer material dispensed by the pump assembly; the output lines merging into a mixer line containing a mixing element which receives and mixes the coloring dye material and the developer material dispensed by the pump assembly to produce a hair formulation; a brushhead connected to the mixer line via a connecting line; the brushhead includes a plurality of tines, one or more of which include openings through which the hair formulation moves, the brushhead further including bristles, which extend past the lower end of the tines, contacting the scalp of the user, the tines being positioned slightly above the scalp, to allow the hair formulation to escape; a handle extending from the brushhead, wherein the brushhead is adapted to move in the handle; and a motor housed in the handle and operatively connected to the brushhead to move the brushhead back and forth in a linear movement oscillation.

BEST MODE FOR CARRYING OUT THE INVENTION

Figure 1:
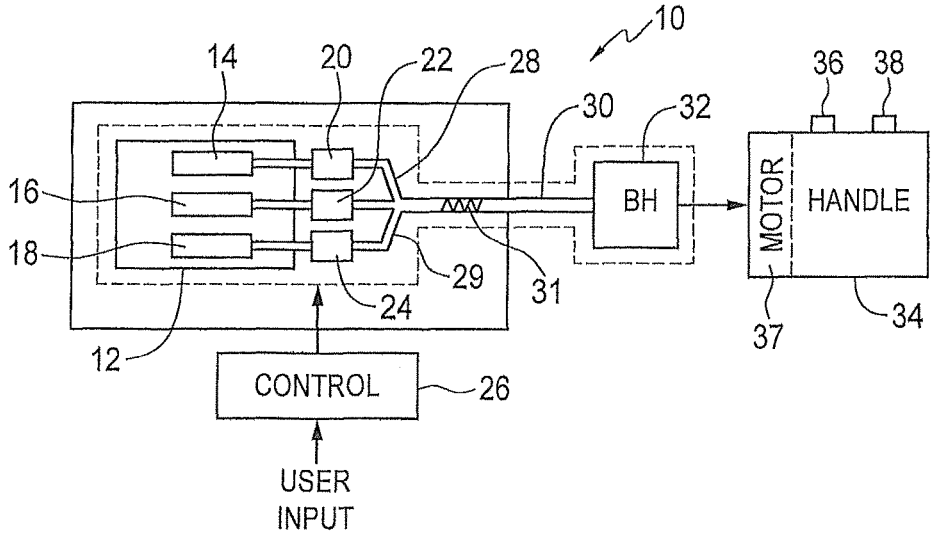
FIG. 1 is a schematic view showing the various portions of the hair coloring system in block form.

FIG. 1 shows a generalized view of the hair coloring system of the present invention at 10. It includes a packet assembly 12 which includes a plurality, two in FIG. 1, of individual color packets, although a single hair coloring packet can be used. Also, a developer packet can be included. Use of a developer with the hair coloring provides a more lasting coloring effect, up to one month or so, referred to as permanent coloring, while without use of the developer, a semi-permanent coloring results, usually lasting approximately a week or so. The developer can be used with multiple coloring packets or a single coloring packet. Each of the hair coloring packets 14 and 16, and the developer packet 18, have their own individual pumps 20, 22 and 24. The individual pumps are controlled by a control assembly 26 which controls each pump to produce a desired color, as explained in more detail below. The outputs of the coloring packet pumps are applied to a color common tube or line 28 while the developer is applied to a developer line 29. The two lines 28 and 29 merge into a mixer line 30, which contains a mixing element 31. The mixer line 30 is connected to a brushhead/distributor element 32 which is mounted in a handle or wand 34.

The operation of the appliance is controlled by an on/off switch 36 which initiates the operation of the pumps, for dispensing the hair color formulation through the brushhead. The handle 34 also includes a driver motor 37 which provides a controlled movement of the brushhead to assist in the application of the color formulation to the hair. This action is controlled by switch 38 which can be separate from the on/off pumping switch 36, although both functions can be controlled by a single switch. The movement of the brushhead can be synchronized with the pumping action of the color formulation.

Figure 2B:
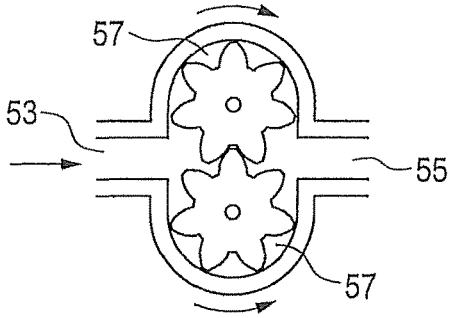
FIG. 2B is a diagram showing a pump portion of FIG. 2A in more detail.
Figure 2A:
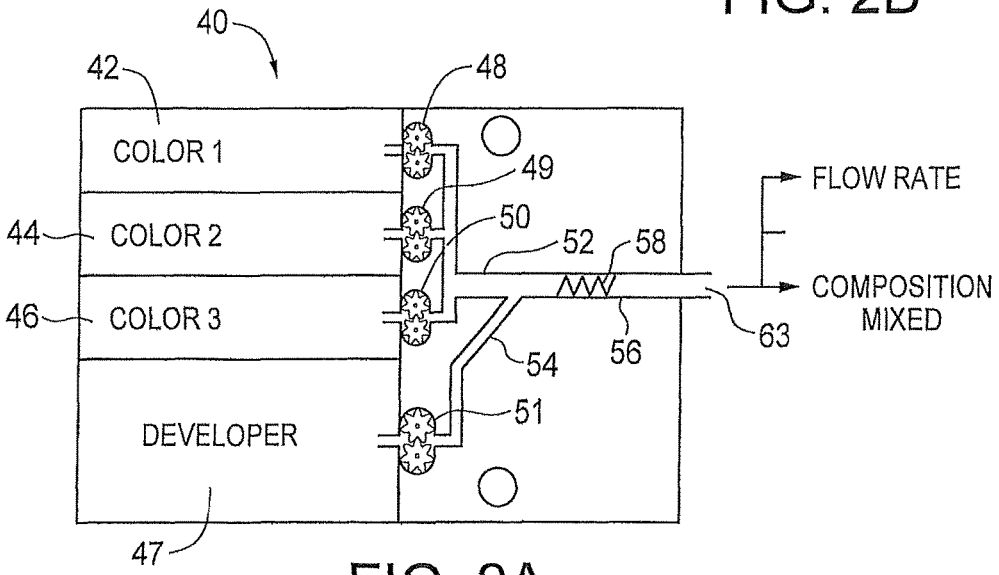
FIG. 2A is a representational diagram showing a portion of the hair coloring system containing the color packets.

FIGS. 2A and 2B show the hair color packet assembly in more detail. This portion of the system, along with the extended connecting tube 56 with the mixing element 58 therein and the brushhead, constitutes a consumable portion of the system. It is a completely closed arrangement, so there is no setup or cleanup involved. Each hair coloring event will typically have its own consumable, which is discarded following use.

Figure 6:
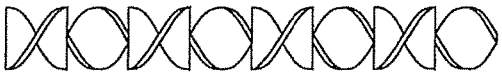
FIG. 6 is a diagram showing the formulation mixer for the hair coloring system.

FIG. 2A shows in representational form a particular packet assembly 40 arrangement with three separate, individual color packets or chambers 42, 44, 46. A developer packet 48 is also included in the assembly. Various structural arrangements, i.e. appliance housings, for containing the color chambers and their associated pumps and the mixing line are possible Each color packet or chamber or developer packet or chamber has its own separate associated pump 48-51. The packet assembly is positionable in and removable from the appliance body. A connecting line 63 connects the packet assembly to the brushhead (not shown). In one embodiment, the color packets are made of flexible plastic having a volume of approximately 60 cc. The developer packet has a volume of approximately 60 cc. The pumps are conventional, as illustrated in FIG. 2B. The hair color or developer enters the pump at entry point 53 and exits at exit point line 55. Details concerning pump action to produce related colors are set forth below. In one embodiment, the colors in the three packets include blond, red and dark brown. Typically, this is sufficient to provide a large number of different colors. The color formulations can be provided by various color hair dye manufacturers. One example is color dyes from L'Oreal SA. The exit line of each pump will be directed to a color packet connection line 52 and the developer pump will exit to a developer line 54. The lines 52 and 54 will meet to a mixer line 56 in which is positioned a conventional mixing element 58 (FIG. 6). As the colors enter mixing line 56, the mixer 58 combines them to produce the final desired color which is provided to a brushhead through a connecting tube 63, which is described in more detail below. The mixer element is conventional, comprising a single member, non-movable, configured as shown, so that the fluid must follow a tortuous path and become thoroughly mixed.

The individual pumps 48-51 are separately controlled by a microprocessor and motor arrangement, also referred to as a control assembly, to produce the final desired color from the three color packets and the developer packet. This arrangement is shown at 59 in more detail in FIG. 3. A control microprocessor is shown at 64. The microprocessor 64 controls a motor drive circuit 66 which in turn controls a series of motors 68-71, one motor for each pump. The control assembly 59 is connectable to the packet assembly 75 and the individual pumps thereon via a gearbox and shaft coupling, shown generally at 74, with the drive shaft for the packet pumps shown at 74A. The packet outlet 75A is shown with the output connecting line 76 extending to the brushhead/distributor.

Figure 3:
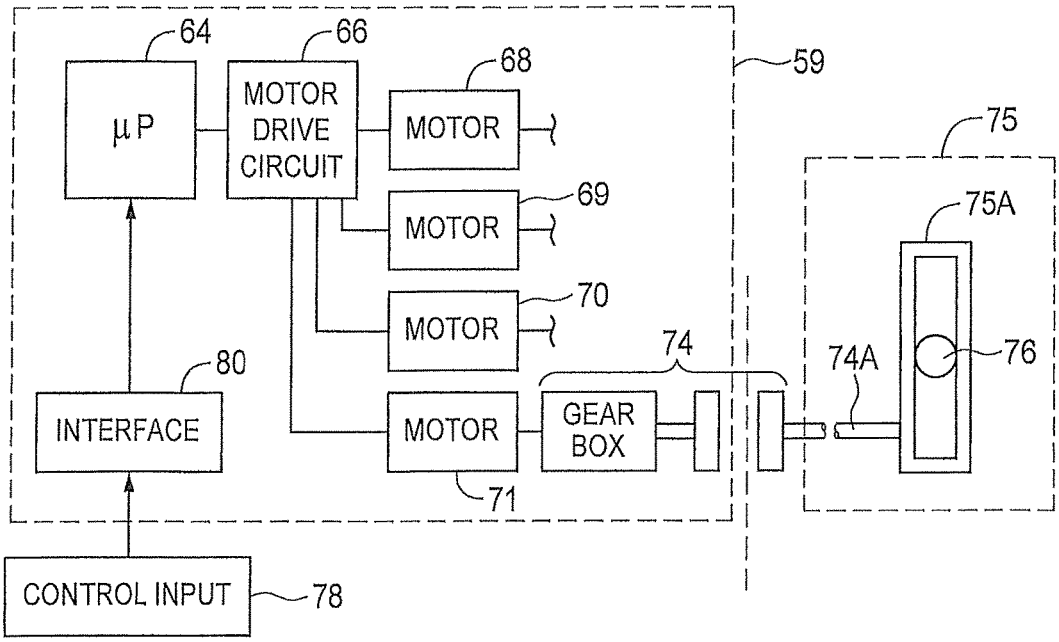
FIG. 3 is a block diagram showing the control assembly for the hair coloring system.

The microprocessor can be controlled in various ways by a user to produce the desired color, shown at 78 in FIG. 3. One way is by means of a color card which is read optically at interface 80. The information is then transmitted to the microprocessor. The color card is thus used in essence to program the microprocessor, which in turn controls the motors which drive their associated pumps, to produce the selected color on the card. The control information is stored in a table or the like in the microprocessor.

In operation, the preferred flow rate in connecting line 63 in FIG. 2A is 150 ml in two minutes, or 1.25 ml per second. Preferably, the combined flow rate from the color packets 42, 44 and 46 in FIG. 2 is approximately equal to the flow rate from the developer packet 48, i.e. 0.625 ml per second. Each of the motors for the individual pumps in the embodiment shown is a gear motor with a maximum RPM of 200. If the gear:volume ratio is 0.25, it is possible to solve for gear diameter "d", as set forth below. Each pump separately will produce 0.75 ml/sec max.

Referring to FIG. 2B, for one embodiment, to produce the desired flow rate, with a gear of diameter d and an unfilled gear cavity 57 ratio of $R_v$, one rotation will produce a volume of $2\pi(d/2)^2 \cdot R_v t$ $cm^3/cm$, where t is the thickness of the gear. Multiplying the volume by RPM will produce the gear flow rate. With a gear thickness of 3 mm and a gear cavity ratio of 0.25, $2\pi(d/2)^2 \cdot R_v \cdot t \cdot RPM = 0.75$ cc/min); solving for d (gear diameter) equals 0.18 cm, or approximately 2 mm in diameter to produce the desired flow rate. It should be understood, however, that other pump arrangements can be used to produce other flow rates or the same flow rates.

Each pump in the embodiment shown has 20 separate distinct steps in pumping rate. With three color packets, the various combinations of the three colors and the developer will result in a total of 210 different color combinations possible.

Other control/interface combinations can be used, including a bar code on a card and associated reader or an RFID tag and an associated reader, or by a wireless command. Also, it would be possible to program the microprocessor using voice commands, both for color and to control the pumping action, i.e. the flow rate. As discussed above, the individual pumps can be controlled to produce the desired flow rate, as well as the particular color composition.

Figure 9:
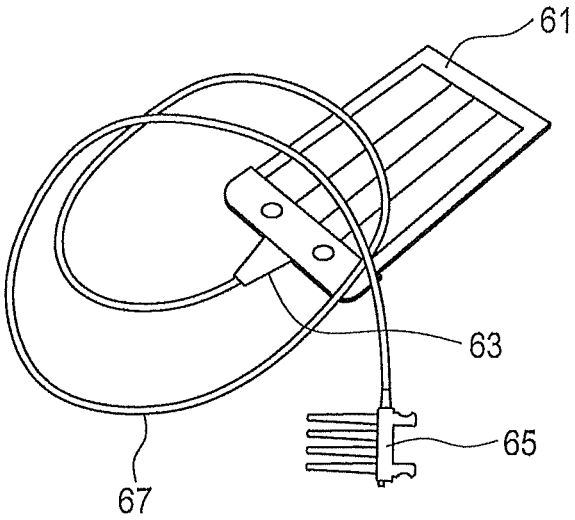
FIG. 9 is a schematic view of a consumable, disposable portion of the hair coloring system of the present invention.

The apparatus, in the embodiment shown, is powered by a battery, with a sealed closed-path construction so that the appliance can even be used safely in the shower. One advantage to a closed path is to protect the user from exposure to the coloring fluid, except on the hair. The disposable assembly portion of the system, shown in FIG. 9, includes the packet assembly and the associated pump/motor arrangement 61, the mixing portion 63 and the dispensing brushhead/distributor 65, as well as a connecting line 67. The color communication element, such as the particular color card used to program the microprocessor, can also be a single-time consumable item.

FIGS. 4, 5, 7 and 8 show the brushhead/dispenser 79 for the system, both alone and in combination with an associated handle or wand.

Figure 4A:
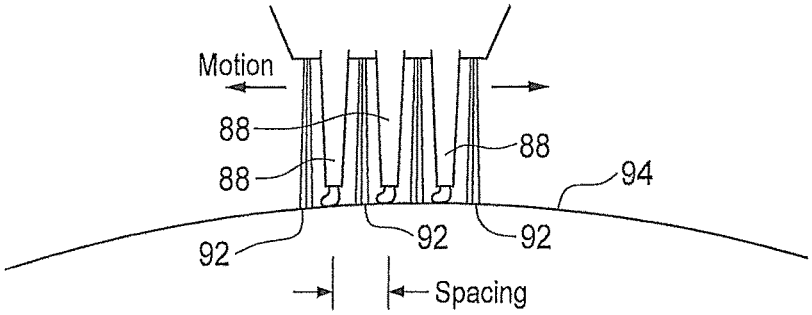
FIGS. 4A and 4B are elevational and end views, respectively, of the brushhead portion of the hair coloring system.
Figure 4B:
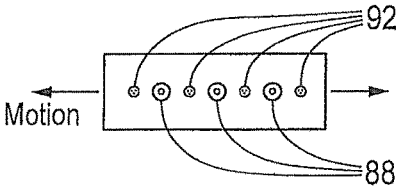
Figure 7A:
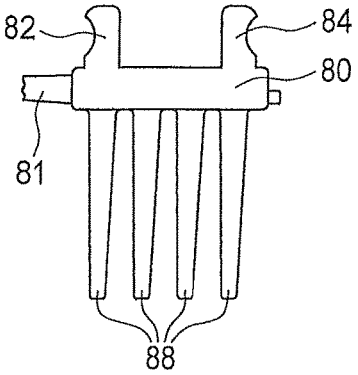
FIG. 7A is an elevational view of a brushhead/distributor used in the present system.
Figure 7B:
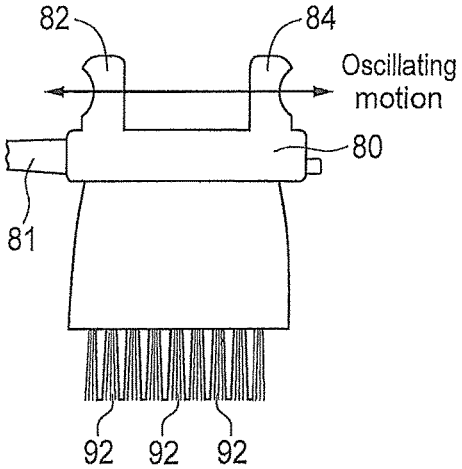
FIG. 7B is an elevational view of a brushhead/distributor with bristles showing the movement thereof.
Figure 8:
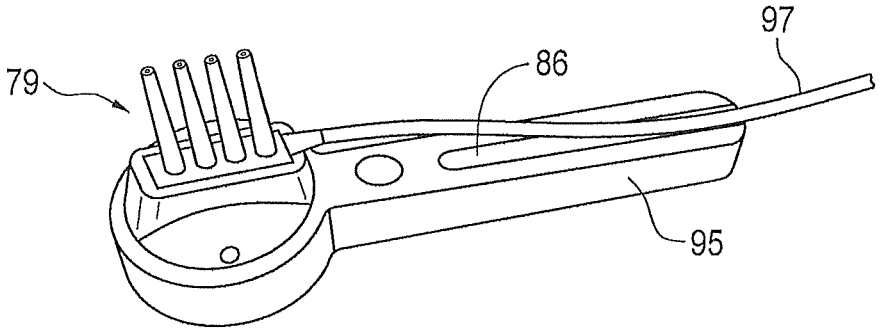
FIG. 8 is a schematic diagram showing the handle portion of the coloring system with a brushhead attached thereto.

FIGS. 7A and 7B show one brushhead arrangement. It includes an upper portion 80 to which a connecting line from the mixing assembly is attached at inlet 81. Extending from the upper portion are two clips 82 and 84 which connect the brushhead to a handle 86, shown in FIG. 8. Extending downwardly from the upper portion are a series of hollow tines 88-88. In the embodiment shown, the tines are approximately 0.7 inches long and have an opening approximately 0.030 inches in diameter at the distal end thereof for exit of the hair color formulation. The tines are separated by a distance of approximately 0.25 inches in one embodiment to permit the positioning of intermediate nylon bristle tufts 92-92. The bristles extend just past the lower end of the tines, contacting the scalp 94, as shown in FIG. 4A. In the embodiment shown, the bristle tufts have approximately 15 individual bristle elements, in a tuft approximately 0.1 inches in diameter. As indicated above, in use, the bristles contact the scalp, while the tines are positioned slightly above the scalp, allowing the hair formulation to escape.

Figure 5:
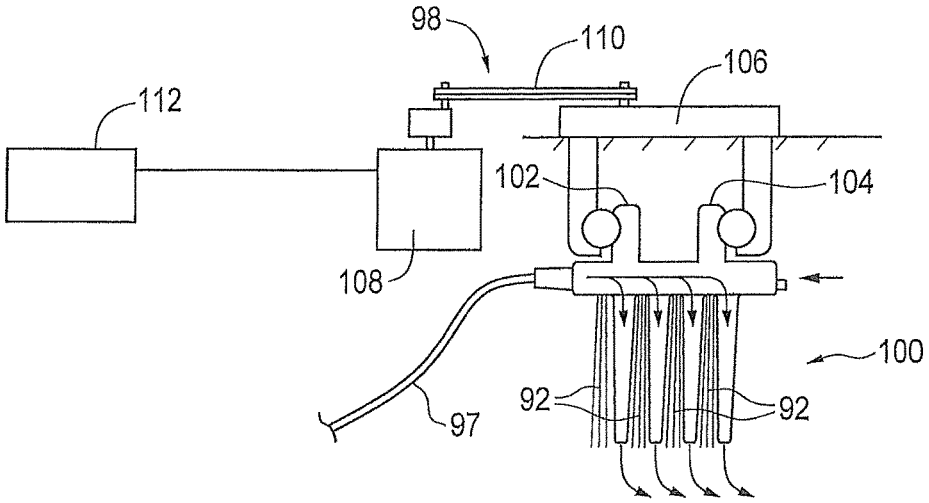
FIG. 5 shows a simplified diagram of a drive system for the brushhead.

The handle 86 (FIG. 8) has an extended portion 95 which is easy to grasp by a user. The connecting line 97 from the color formulation mixer extends along the handle. The brushhead is snapped into place into the handle by clips 82, 84. The system can operate as described above by action of the on/off switch 36 which begins the pumping action for hair formulation at the desired flow rate. The pumping rate can be controlled by a slidable switch or by voice actuation to control the motor RPM for the pumps. The handle can also include a motor arrangement 98, which is shown generally in FIG. 5, to provide a linear oscillating motion of the brushhead/distributor. The oscillation has a frequency in the range of approximately 15-60 Hz, with an amplitude which is greater than one-half the distance between adjacent tines but no more than 1.5 times that distance. FIG. 5 shows a simplified drive arrangement for brushhead 100 which is snap-fitted via clips 102, 104 to a slidable tray 106 on the handle. The slidable tray is moved back and forth linearly by a motor 108 with a connecting rod 110. The motor is controlled by a switch 38 on the handle (FIG. 1) and has a separate power supply 112. Other arrangements for controlling the linear oscillation movement of the brushhead can be used. The linear motion simulates the gloved finger rubbing of the formulation by the user into the root and hairline areas, resulting in a reliable and accurate control over the coloring for those hair areas.

When the hairline and roots coloring functions are completed, an optional coarser brushhead can be used with wider tine spacing to glide through the hair, with fluid being continually dispensed at a selected rate to coat the hair. An adjustment can be made to dispense fluid to each tine, thus conveniently providing fluid to the bulk of the hair. Fairly long strokes are used to dispense the formulation along the hair so that slight variation in color programmed into the mixing portion of the appliance can provide an improvement to the appearance of natural color variation verses single color systems.

It should be understood that natural color variation is important to a high quality coloring result. Since the color is mixed in real time in the present system, the color composition can be made to vary to any degree over time to produce color variation, by simply programming the microprocessor. For instance, each brush stroke through the bulk of the hair can produce a slightly different tint or shade. Further, a multi-tube connecting arrangement could be used for transfer of a different color to different tines of the brushhead, so that small individual hanks of hair can receive a different color when compared to the neighboring hanks. Conventionally, color variation requires coloring of small hanks of hair and protecting them by aluminum foil to prevent bleeding through from one hank to the next and to prevent premature drying of small hanks of hair with such a relatively unfavorable volume-to-volume ratio. With the present system, there are two ways of eliminating the foil process. One is to provide slight color variation as described above so that a bleed-through from one hank to the next is not noticeable. The results of using this method or technique will be less natural than a salon treatment, but an improvement over single color approaches. Another way is to provide separately fed tines in the brush so that the individual tines can dispense different color formulations, to permit meaningful color transfer from one hank of hair to the next.

Accordingly, the present invention is convenient to use, with high performance, providing significant confidence for the user in the results. With the closed fluid path, there is no need to pour and shake separate containers. The present system can be used in the shower, which enhances cleanliness and further eliminates the required care and time of cleaning components, gloves and the need for manual manipulation of the hair roots and hairline necessary with conventional hair coloring systems. The present system results in a significant improvement in both reliability and color variability of home use hair coloring systems.

Although a preferred embodiment has been disclosed for purposes of illustration, it should be understood that various changes, modifications and substitutions may be incorporated in the preferred embodiment without departing from the spirit of the invention as defined by the claims which follow:

What is claimed is:

1. A hair coloring system, comprising:

a hair color packet assembly having at least two coloring material chambers, each containing different coloring dye material, and one or zero developer material chamber containing developer material;

wherein each of the coloring material chambers and the one or zero developer material chamber includes a pump operatively coupled thereto for dispensing the coloring dye material or the developer material associated therewith, each pump having an output line therefrom for receiving the coloring dye material and the developer material dispensed by the pumps associated therewith, the output lines merging into a mixer line containing a mixing element which receives and mixes the coloring dye materials or the coloring dye materials and the developer material dispensed by the pumps;

a control assembly including a microprocessor operable to control each of the pumps separately to dispense each of the coloring dye materials and developer material over a range of flow rates, wherein the microprocessor has control information stored therein for producing hair colors and responds to a user's input of a selected hair color to control the pumps to dispense appropriate combinations of one or more of the hair coloring dye materials and developer material to produce a hair formulation for the selected hair color, following mixing;

a brushhead connected to the mixing line via a connecting line wherein the brushhead includes a plurality of tines, one or more of which include openings through which the mixed dye materials and developer material move, the brushhead further including bristles which in use extend just past lower ends of the tines, contacting the scalp and the tines are positioned slightly above the scalp to allow the hair formulation to escape therefrom;

a handle extending from the brushhead; and wherein the hair color packet assembly, the pumps, the output lines, the mixing line, the connecting line and the control assembly are external to the handle and the brushhead.

2. The system of claim 1, wherein the bristles are positioned intermediate of the tines.

3. The system of claim 1, including more than one brushhead for use in coloring different parts of a user's hair.

4. The system of claim 1, wherein the pump assembly is controlled to produce a formulation flow rate in the connecting line of approximately 1.25 ml/second.

5. The system of claim 1, wherein the at least two coloring material chambers comprise three to five different coloring material chambers and the one or zero developer material chamber comprises one developer material chamber.

6. The system of claim 1, wherein the one or zero developer material chamber comprises one developer material chamber and a combined flow rate of the coloring dye materials is approximately equal to a flow rate of the developer material.

7. The system of claim 1, wherein the connecting line comprises a plurality of connecting lines extending from the mixer line to the brushhead, arranged to provide different colors to different tines of the brushhead.

8. A single use hair color consumable assembly for use with a hair coloring system, comprising:

a hair color packet assembly having at least two coloring material chambers each containing coloring dye material and one or zero developer material chamber containing developer material, each of the dye materiel chambers and the one or zero developer material chamber having a pump operatively coupled thereto for dispensing the coloring dye materials or the developer materials associated therewith, each pump having an output line therefrom for receiving the coloring dye materials and developer material dispensed by the pumps associated therewith, the output lines merging into a mixer line containing a mixing element which receives and mixes the coloring dye materials or the coloring dye materials and the developer material dispensed by the pumps;

a microprocessor operably coupled to each of the pumps, wherein the microprocessor includes control information stored therein for producing colors and responds to a user's input of a selected color to control the pumps to dispense appropriate combinations of one or more of the coloring dye material and the developer material to produce a hair formulation for the selected color, and wherein the pumps are responsive to a control signal from the microprocessor for variably controlling the flow rate of the coloring dye materials and developer material to produce the hair formulation; and a brushhead member connected to the mixing assembly by a connecting line, wherein the brushhead includes a plurality of tines, one or more of which include openings through which the mixed coloring dye materials or developer materials move, the brushhead further including bristles which in use extend just past the lower end of the tines, contacting the scalp, and the tines are positioned slightly above the scalp to allow the hair formulation to escape therefrom, wherein the hair packet assembly, the pumps, the output lines and the mixer line are separable from the brushhead and disposable.

9. The system of claim 8, wherein the bristles are positioned intermediate of the tines.

10. A hair coloring system, comprising;

a hair color packet assembly having at least two coloring material chambers each containing dye material and one or zero developer material chambers containing developer material;

wherein each of the coloring material chambers and the one or zero developer material chamber includes a pump operatively coupled thereto for dispensing the coloring dye material or the developer material associated therewith, each pump having an outlet line for receiving the coloring dye material and the developer material dispensed by the pumps associated therewith, the output lines merging into a mixer line containing a mixing element which receives and mixes the coloring dye materials or the coloring dye materials and the developer material dispensed by the pumps;

a control assembly including a microprocessor operable to control each of the pumps separately to dispense each of the coloring dye materials and developer material over a range of flow rates, wherein the microprocessor includes control information stored therein for producing colors and responds to a user's input of a selected color to control the pumps to dispense appropriate combinations of one or more of the hair coloring dye materials and developer material to produce a hair formulation for the selected color, following mixing;

a brushhead connected to the mixer line via a connecting line, wherein the brushhead assembly includes a plurality of tines, one or more of which include openings through which the mixed dye materials and the developer material move, the brushhead further including bristles which extend just past the lower ends of the tines, contacting the scalp, wherein the tines are positioned slightly above the scalp allowing the hair formulation to escape therefrom;

a handle extending from the brushhead wherein the brushhead is adapted to move in the handle; and a motor housed in the handle and operatively connected to move the brushhead back and forth in a linear movement oscillation;

wherein the hair color packet assembly, the pumps, the output lines, the mixing line, the connecting line and the control assembly are external to the handle and the brushhead.

11. The system of claim 10, wherein the bristles are positioned intermediate of the tines.

12. The system of claim 10, wherein the linear movement of the tines is greater than ½ the distance between successive tines and no greater than 1½ times the distance between successive tines.

13. The system of claim 10, wherein the color packet assembly, the pumps, the output lines, the mixer line, the connecting line and the brushhead are separable from the handle and disposable.

14. The system of claim 10, wherein the pump assembly is controlled to produce a formulation flow rate in the range of 10 cc/minute-300 cc/minute.

* * * * *